US011549269B2

(12) United States Patent
Hochstetler et al.

(10) Patent No.: US 11,549,269 B2
(45) Date of Patent: Jan. 10, 2023

(54) STANDOFF FOR MOUNTING PANEL AND METHOD FOR MOUNTING PANELS

(71) Applicant: Heartland Stairways, Inc., Holmesville, OH (US)

(72) Inventors: Roy Hochstetler, Holmesville, OH (US); Delon Shetler, Kidron, OH (US); John Mark Wengerd, Fredericksburg, OH (US); Marvin Yoder, Holmesville, OH (US)

(73) Assignee: Heartland Stairways Inc., Holmesville, OH (US)

( * ) Notice: Subject to any disclaimer, the term of this patent is extended or adjusted under 35 U.S.C. 154(b) by 0 days.

(21) Appl. No.: 17/153,242

(22) Filed: Jan. 20, 2021

(65) Prior Publication Data

US 2021/0222440 A1 Jul. 22, 2021

Related U.S. Application Data

(60) Provisional application No. 62/963,422, filed on Jan. 20, 2020.

(51) Int. Cl.
*E04F 13/08* (2006.01)
*E04F 11/18* (2006.01)
*E04F 13/14* (2006.01)

(52) U.S. Cl.
CPC ..... *E04F 13/0833* (2013.01); *E04F 11/1812* (2013.01); *E04F 11/1853* (2013.01); *E04F 13/145* (2013.01); *E04F 2011/1895* (2013.01)

(58) Field of Classification Search
CPC ..... E04F 13/0833; E04F 11/1812; E04F 11/1853; E04F 13/145; E04F 2011/1895; E04F 11/116; E04F 2011/0216
USPC ..... 52/506.06
See application file for complete search history.

(56) References Cited

U.S. PATENT DOCUMENTS

| | | | | |
|---|---|---|---|---|
| 6,430,894 | B1 * | 8/2002 | Chae | E04B 2/885 52/204.593 |
| 6,860,689 | B1 * | 3/2005 | Attanasio | B64C 1/12 411/353 |
| 8,628,049 | B2 * | 1/2014 | Ghatikar | E04B 9/18 248/231.91 |
| 9,636,786 | B2 * | 5/2017 | Tsui | F16B 5/0225 |
| 10,393,161 | B2 * | 8/2019 | Tanner | B23P 19/02 |
| 11,078,663 | B1 * | 8/2021 | Wigboldy | E04B 1/7637 |
| 2011/0030302 | A1 * | 2/2011 | John J. | E04F 13/088 52/489.1 |
| 2011/0064539 | A1 * | 3/2011 | Ghatikar | E04F 13/0837 411/371.2 |

(Continued)

*Primary Examiner* — Patrick J Maestri
(74) *Attorney, Agent, or Firm* — Fred Zollinger

(57) ABSTRACT

A standoff for mounting panels such as glass panels in architectural applications include a plurality of parts that are first mounted to the panel and are then used to identify the locations for the anchor fasteners in the support structure or to locate the anchor fasteners as they are driven into the support structure. One configuration includes a bushing that defines a through opening. The bushing is placed through an opening the panel to be mounted. A barrel defining its own opening is then placed on the portion of the bushing that extends from the panel. The through hole of the bushing is aligned with the opening of the bushing such that an anchor fastener can pass through the bushing and the barrel into a support structure to which the panel is to be mounted.

21 Claims, 9 Drawing Sheets

(56) References Cited

U.S. PATENT DOCUMENTS

2018/0112412 A1* 4/2018 Mao-Cheia ..... E04F 13/0837

* cited by examiner

STANDOFF FOR MOUNTING PANEL AND METHOD FOR MOUNTING PANELS

CROSS REFERENCE TO RELATED APPLICATIONS

This application claims the benefit of U.S. Provisional Patent Application No. 62/963,422 filed Jan. 20, 2020; the disclosures of which are incorporated herein by reference.

BACKGROUND OF THE DISCLOSURE

1. Technical Field

This disclosure generally relates to mounting equipment for panels and, more particularly, to mounting standoffs used to support glass panels in architectural applications.

2. Background Information

Various architectural applications use panels to perform a function. Metal, composite, polymer, wooden, and glass panels are used for various applications and many of these desire attractive, secure, and convenient mounting solutions. For example, glass panels are used as a balustrades disposed at the edge of a staircase or balcony. The glass panels are supported by standoffs that are anchored in a structural support. The structural support is often the stair tread or the floor of the balcony. The standoffs are usually mounted into the sides of these structural supports to support the lower portion of the glass panels. The glass panels are formed with mounting openings for the standoffs. The installation process requires the installer to accurately identify the locations when the standoffs will engage the structural support and then mount a portion of the standoffs at these locations. Although some standoffs allow for adjustments, these installations must be precise so that all of the glass mounting openings line up with the portions of the standoffs installed in the structural support. This process takes time and leave little room for error. Further, checking the positions of the standoff installations by holding up the glass panels requires multiple workers because the glass panels are usually heavy, don't have convenient gripping surfaces, are breakable, and are often being installed at elevation along the edges of stairs or along balconies. Different installation solutions are thus desired in the art.

SUMMARY OF THE DISCLOSURE

The disclosure provides standoff configurations for mounting panels such as glass panels in architectural applications. The standoff configurations of this disclosure include a plurality of parts that are first mounted to the panel and are then used to identify the locations for the anchor fasteners in the support structure or to locate the anchor fasteners as they are driven into the support structure.

In one configuration, the disclosure provides a standoff that includes a bushing that threads into a barrel with the panel disposed between an inner surface of a head of the bushing and an outer end of the barrel. The bushing and barrel define aligned openings that receive the anchor fastener. The aligned openings can be used to identify the location where the anchor fastener will be installed, to drill a pilot hole for the anchor fastener, or to allow the anchor fastener to be driven directly into the support surface. An end cap that usually matches the shape of the barrel is connected to the outer end of the bushing to provide a desirable finished appearance to the standoff. The barrel and end cap can be round, square, or other shapes as desired. In this configuration, the force of tightening the anchor fastener into the support structure is transmitted from the bushing through the barrel to the support structure without being transferred to the glass because of the threaded connection between the bushing and the barrel.

In another configuration, the disclosure provides a standoff that includes a bushing that slides into a barrel with the panel disposed between an inner surface of a head of the bushing and an outer end of the barrel. The bushing and barrel define aligned openings that receive the anchor fastener. The aligned openings can be used to identify the location where the anchor fastener will be installed, to drill a pilot hole for the anchor fastener, or to allow the anchor fastener to be driven directly into the support structure. An end cap that matches the barrel shape is connected to the outer end of the bushing to provide a desirable finished appearance to the standoff. The barrel and end cap can be round, square, or other shapes as desired.

The disclosure also provides different bushing and end cap configurations that receive the head of the anchor fastener.

The disclosure also provides configurations, as above, that include a washer disposed between the bushing and the panel.

The preceding non-limiting aspects of the disclosure, as well as others, are more particularly described below. A more complete understanding of the processes and equipment can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

DETAILED DESCRIPTION OF THE DISCLOSURE

Figure 1:
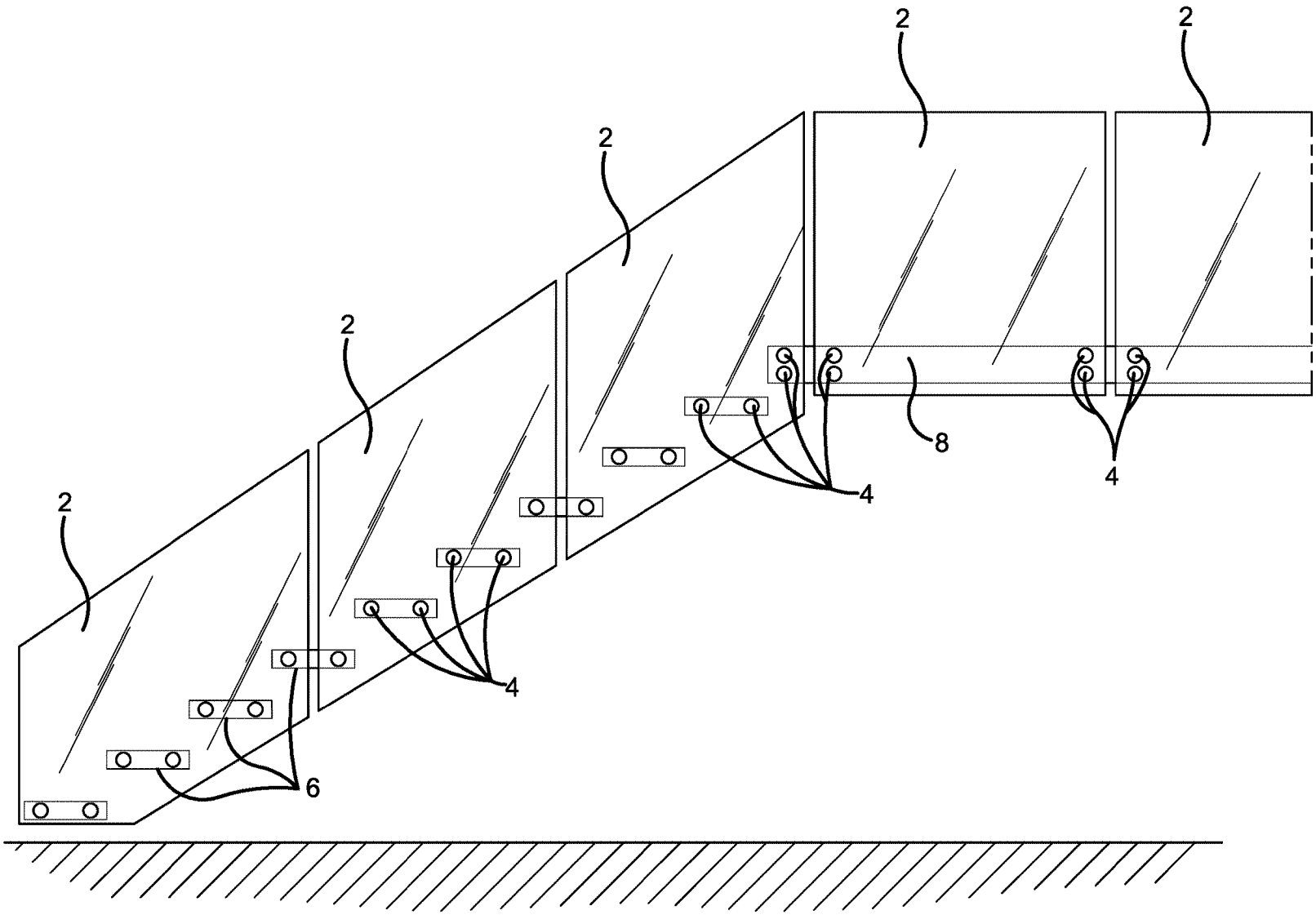
FIG. 1 is an elevation view of stairs and a portion of a balcony with balustrade formed from a plurality of glass panels.

An exemplary balustrade installation using a plurality of panels 2 supported by standoffs 4 is depicted in FIG. 1 with a three panels 2 supported at the ends of stair treads 6 and two panels 2 supported by the floor 8 of the balcony. In the exemplary configuration, panels 2 are glass. Panels 2 can be made from other materials and function with standoffs 4 in the same manner described herein. When panels 2 are formed from glass, the glass is typically tempered glass with a thickness of one-quarter inch to three-quarters inch. Each panel 2 defines an opening 10 for each standoff 4 that is to be used to mount panel 2. Opening 10 have a diameter of one inch. Each standoff 4 includes a plurality of parts that are connected to panel 2 before an anchor fastener 12 is used to secure standoff 4 and panel 2 to support structure 6 or 8.

Figure 2:
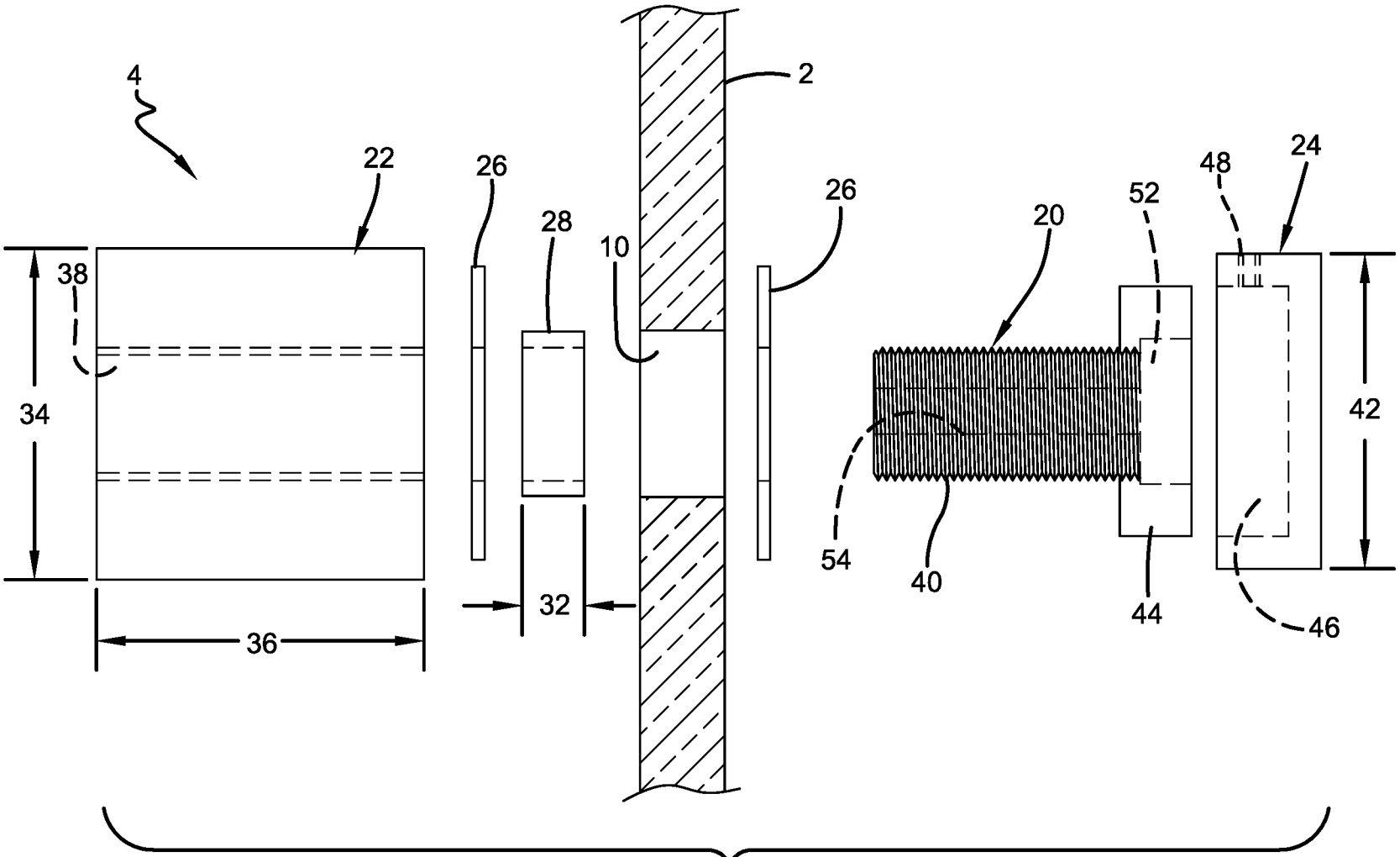
FIG. 2 is an exploded view of a first configuration of a standoff.
Figure 4:
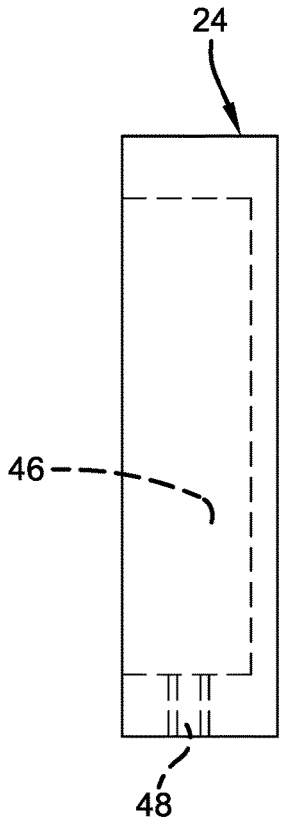
FIG. 4 is a side view of an end cap.
Figure 5:
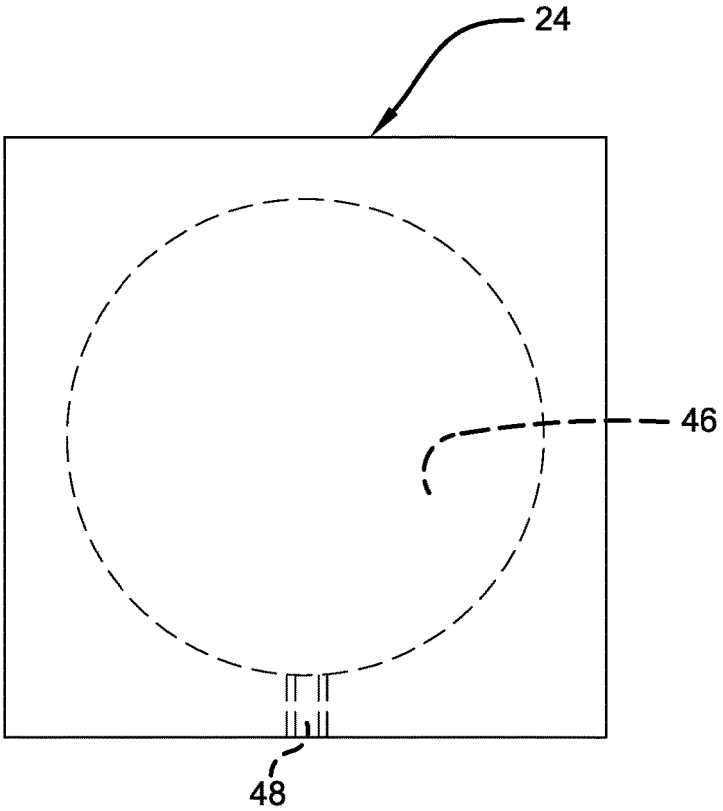
FIG. 5 is an end view of the square end cap.

A first configuration of standoff 4 is depicted in FIG. 2 and generally includes a bushing 20, a barrel 22, and an end cap 24. Standoff 4 can be used with optional exterior washers 26 and an interior washer 28. Washers 26 and 28 are made from a cushioning material such as rubber or plastic. Exterior washers 26 provide cushioning and prevent direct contact between the surfaces of the panel and bushing 20, barrel 22, and end cap 24. Interior washer 28 fits inside opening 10 around a portion of bushing 20. Interior washer 28 is configured to fill most of the space between bushing 20 but does not have to have the same thickness as panel 2. An interior washer 28 having a thickness (dimension line 32 in FIG. 2) of one-quarter inch can be used with panels having thickness of one-quarter inch and greater. Interior washer 28 stops panel 2 from resting directly on bushing 20.

In the exemplary configuration, barrel 22 has either a round cross sectional shape with a two inch diameter (dimension line 34 in FIG. 2) or has a square cross sectional shape with a width of two inches by two inches (also dimension line 34 in FIG. 2). In both the round and square configurations, barrel 22 has a length of two inches (dimension line 36 in FIG. 2). Another exemplary size for barrel 22 is one and one-half inch by one and one-half inch long. The following dimensions are sized for use with the two inch by two inch barrel 22. The dimensions are correspondingly reduced for the smaller barrel. The parts can be provided in a variety of sizes and shapes. Barrel 22 defines a threaded longitudinal opening 38 along its center that is threadedly engaged by a threaded shank 40 of bushing 20. Opening 38 and shank 40 can be about three-quarter inches in diameter. Each exterior washer 26 has an outer dimension (such as an outer diameter) that is less than two inches with an interior opening having a diameter large enough to receive shank 40.

End cap 24 has a cross sectional shape that matches barrel 22 and thus has a diameter of two inches (dimension line 42 in FIG. 2) for the round version or a width of two inches by two inches for the square version. End cap 24 has a thickness sufficient to fully receive the head 44 of bushing 20 within a recess 46 defined by end cap 24. Head 44 has a diameter of one and one-half inches and a thickness of seven-sixteenths inch. Recess 46 thus has a diameter of just larger than one and one-half inches and a depth of just larger than seven-sixteenths inch. A threaded opening 48 threadedly receives a set screw to hold end cap 24 in place.

Figure 7:
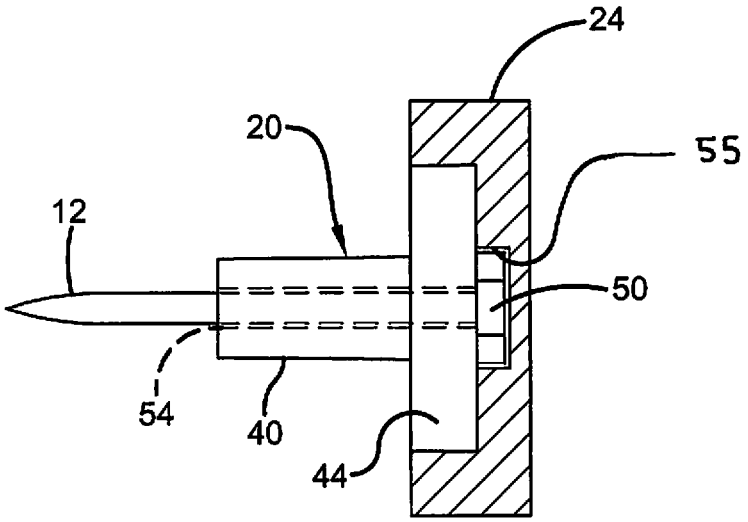
FIG. 7 is a side view, partially in section, of an alternative configuration for a bushing and end cap.
Figure 13:
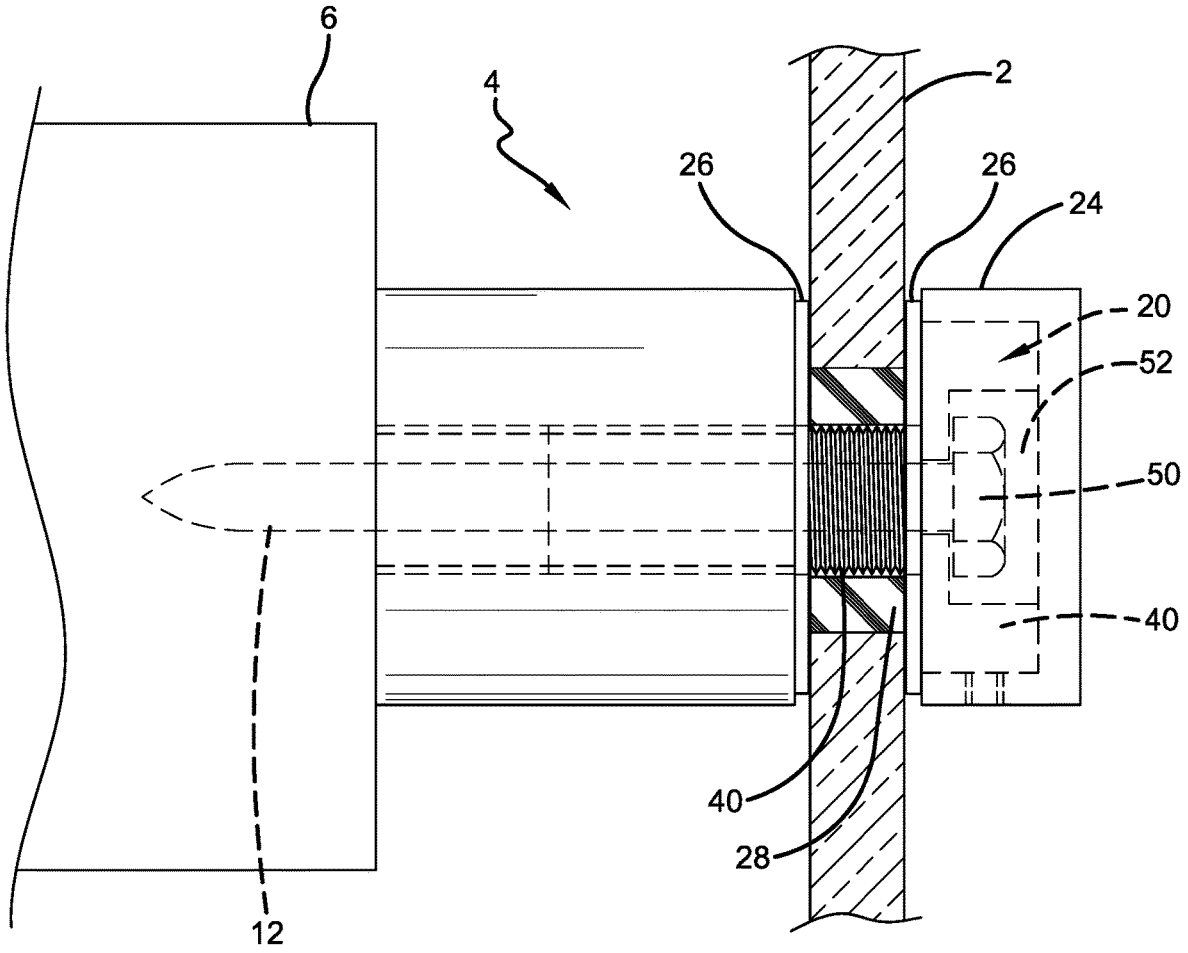
FIG. 13 is an elevation view, partially in section, showing a step of installing the standoff with the anchor fastener secured into the support structure.

In the configurations of end cap 24 depicted in FIGS. 2, 4, 5, 8 and 9-12 the fastener head 50 of anchor fastener 12 is entirely received within a recess 52 defined by head 44 of bushing 20 as shown in FIG. 13. Recess 52 is wide and deep enough to fully receive at least fastener head 50. An alternative configuration is depicted in FIG. 7 wherein end cap 24 defines a recess 55 that receives fastener head 50. Another configuration provides both recesses 52 and 55 to receive fastener head 50.

Figure 3:
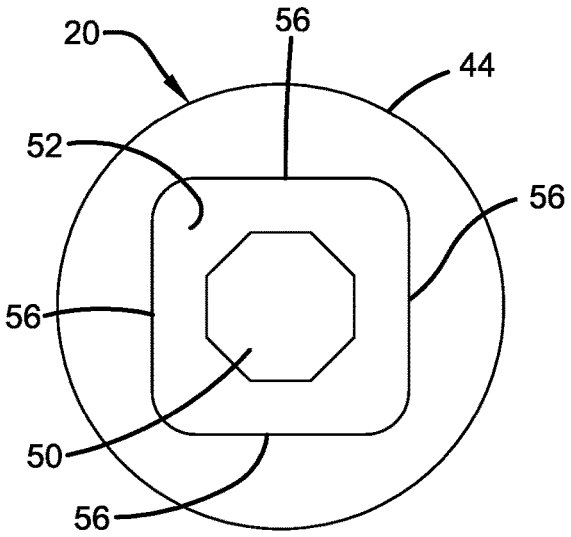
FIG. 3 is an end view of first configuration of the head of the bushing with a fastener head disposed in the bushing recess.
Figure 6:
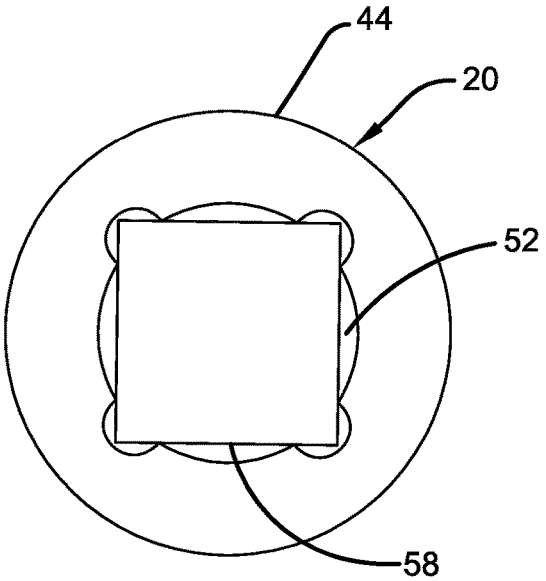
FIG. 6 is an end view of a second configuration of the head of the bushing with a square driver bit fit in the recess.

When fastener head 50 is a lag bolt type that is driven with a socket, recess 52 provides space outward of fastener head 50 as shown in FIG. 3 to accommodate the socket so that anchor fastener 12 may be driven all the way into place. In the configuration of FIG. 3, recess 52 has flat walls 56 that allow bushing 20 to be driven with a driving bit. The alternative configuration of recess 52 depicted in FIG. 6 allows a square driver 58 to be used to rotate bushing 20 with respect to barrel 22 during installation and removal of bushing 20. When recess 52 is round in shape, the outer surface of head 44 can be engaged to rotate bushing into place. This surface can provide openings for a spanner wrench or can include flat surfaces for a wrench.

Figure 10:
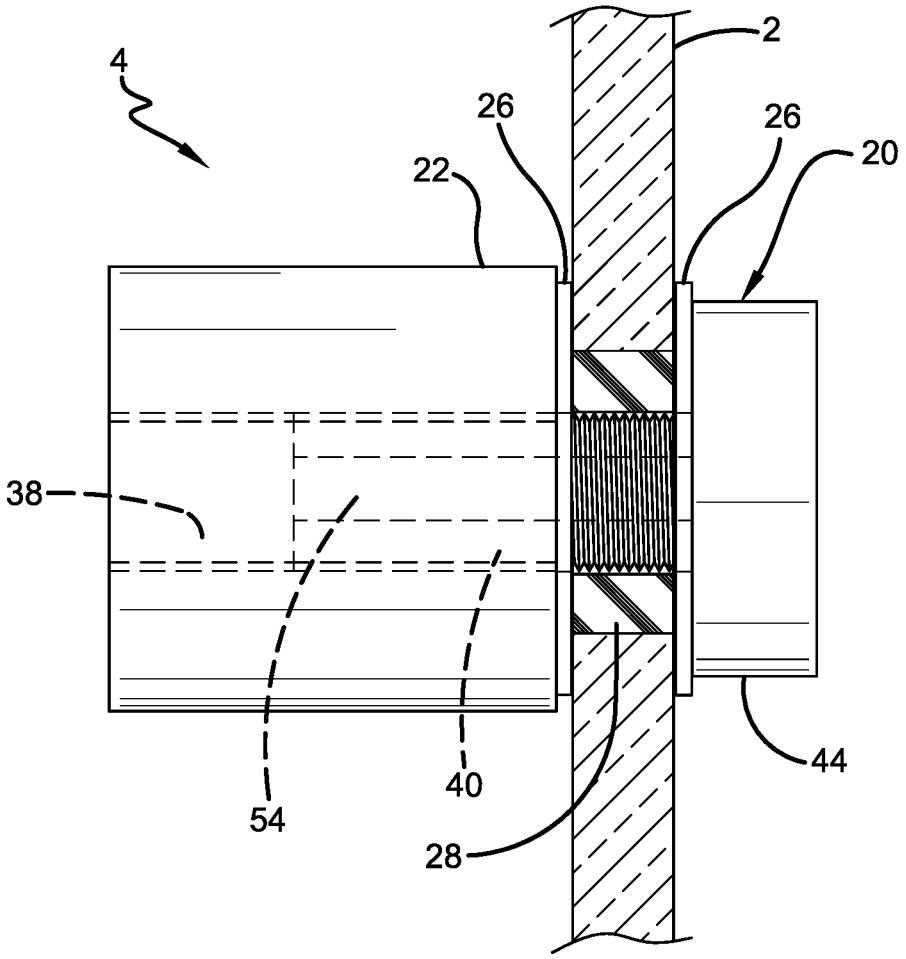
FIG. 10 is an elevation view, partially in section, showing a step of installing the standoff where the barrel is connected to the bushing and the glass is disposed between the washers.
Figure 11:
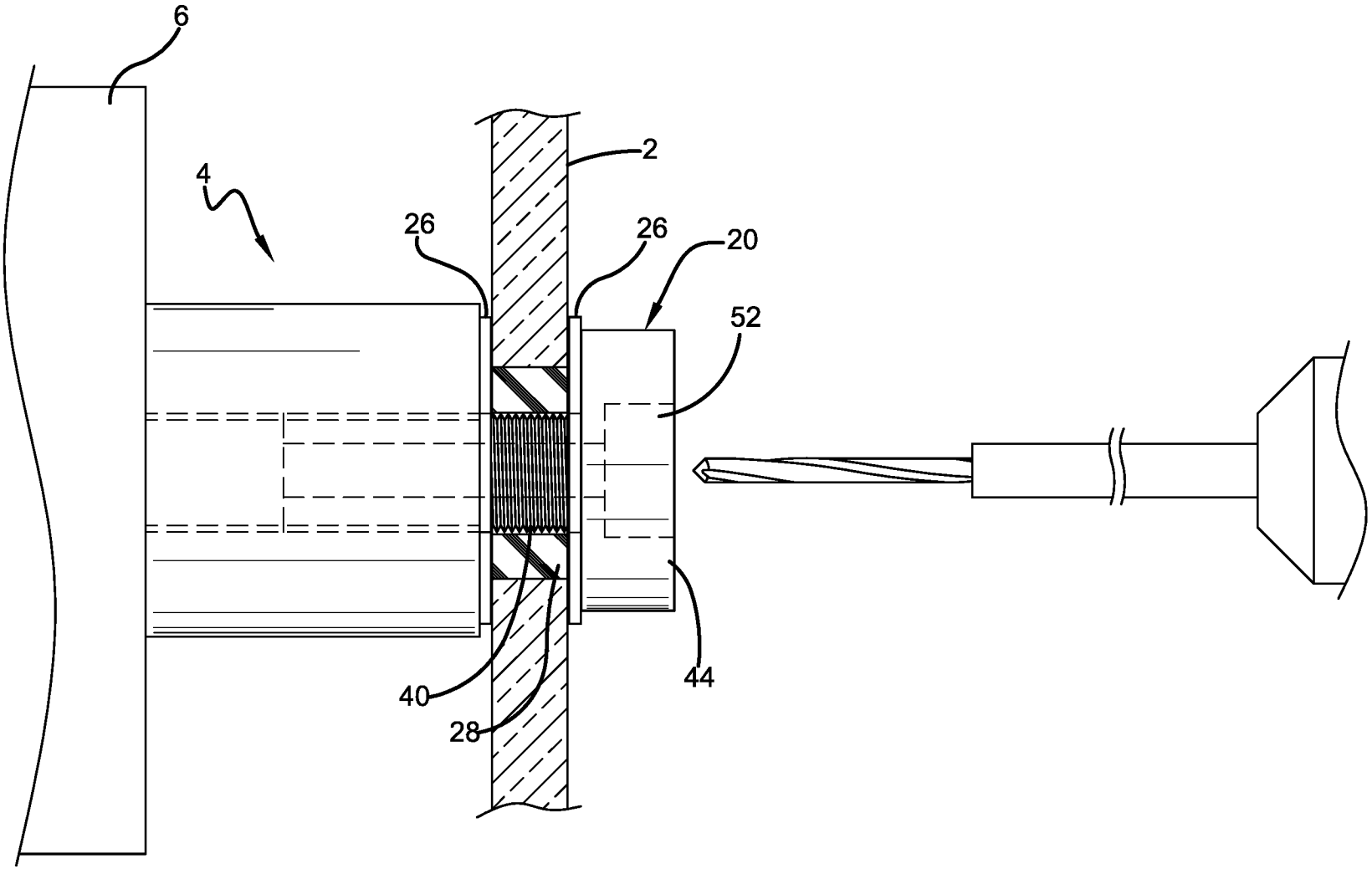
FIG. 11 is an elevation view, partially in section, showing an optional step of installing the standoff where the bushing is used to guide the drilling of a pilot hole.
Figure 12:
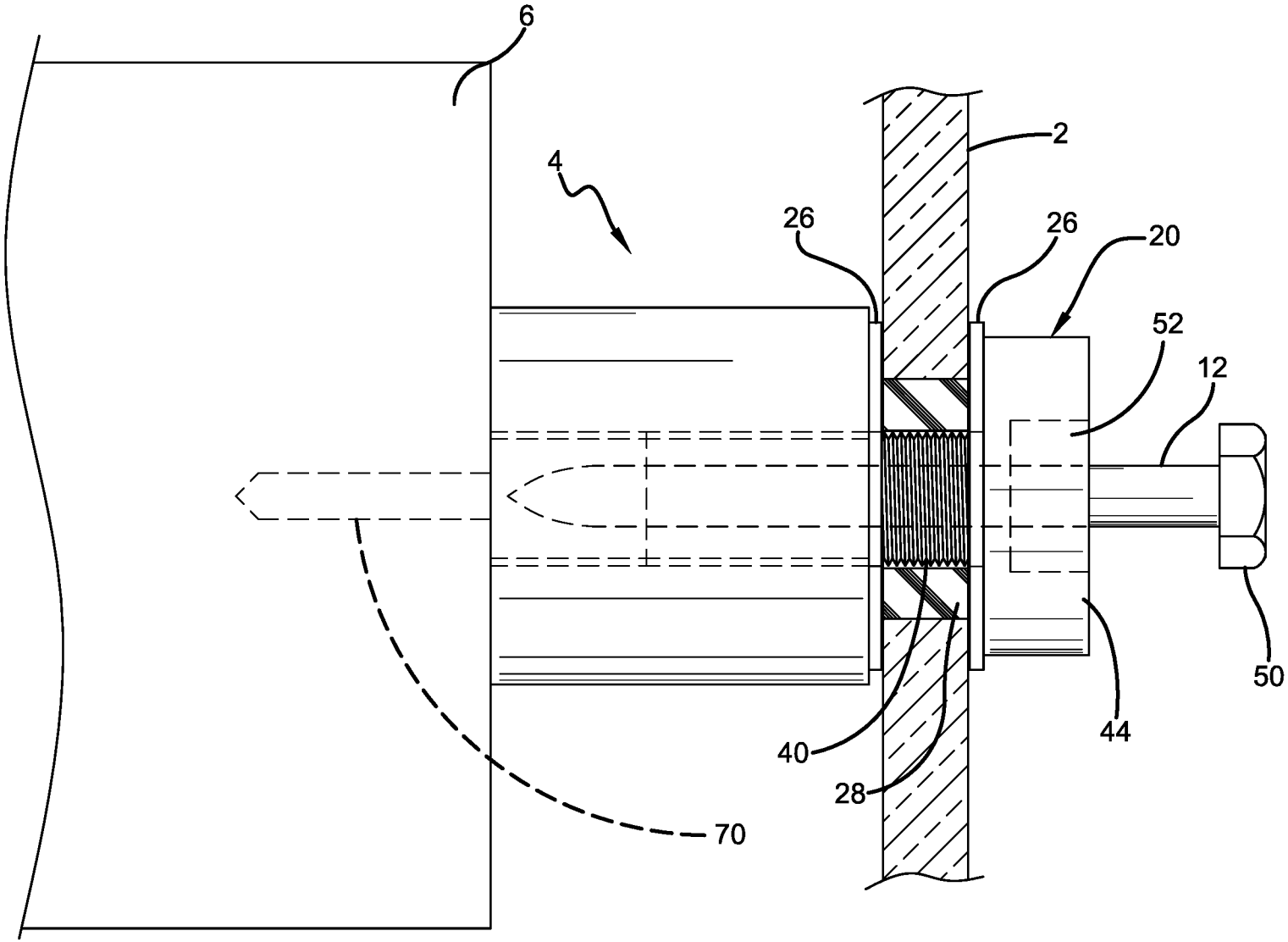
FIG. 12 is an elevation view, partially in section, showing a step of installing the standoff with the anchor fastener disposed through the bushing, the glass panel, and the barrel.

Shank 40 is long enough to extend through panel 2 and substantially into barrel 22 and can be one inch to two inches long in this exemplary configuration. As described above, shank 40 threads into barrel 22. When installed, head 44 of bushing 20 engages the surface of panel 2 or engages washer 26 with barrel 22 engaging the other side of panel 2 or the other washer 28. This position is depicted in FIG. 10. Bushing 20 defines a central longitudinal opening 54 through its center. Opening 54 has a diameter of three-eighths inch in this configuration. Opening 54 slidably receives anchor fastener 12 which can be a lag bolt or lag screw. With the threaded connection between bushing 20 and barrel 22, the tightening of anchor fastener 12 does not increase the force on panel 2 because such force is transferred from bushing 20 to barrel 22 through the threads instead of through panel 2.

Figure 8:
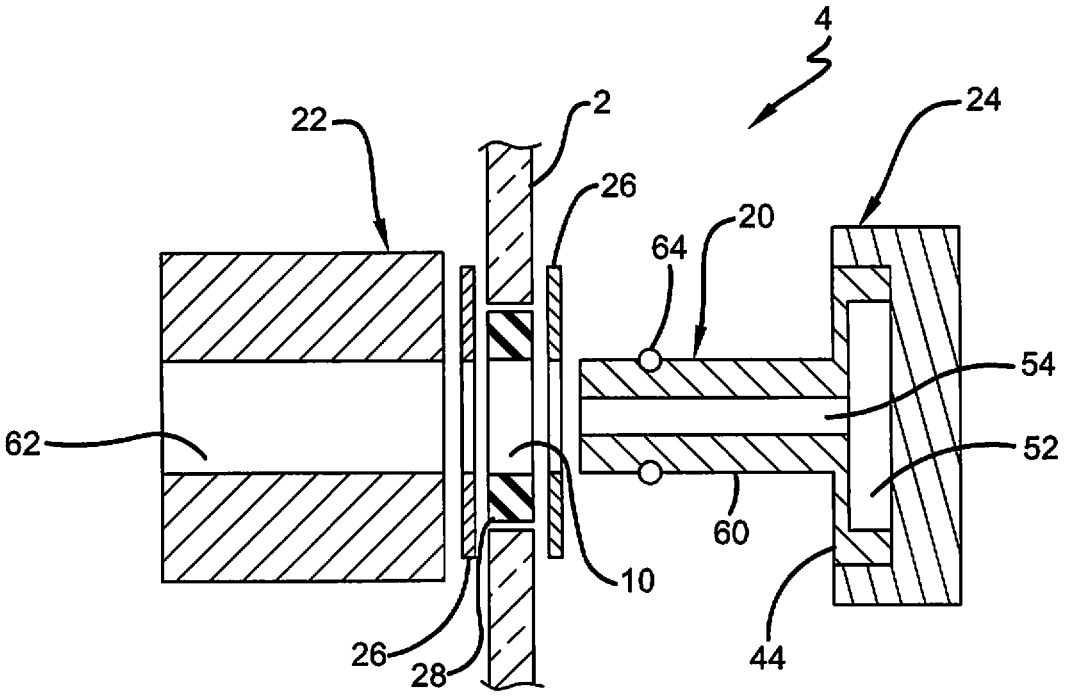
FIG. 8 is a section view of a second configuration of a standoff.

In the alternative configuration of FIG. 8, bushing 20 includes a non-threaded shank 60 that slides into a non-threaded opening 62 defined by barrel 22. This configuration can be used with a simple sliding engagement between shank 60 and opening 62 or, in a further configuration, an O-ring 64 is carried by shank 60 to frictionally connect shank 60 to barrel 22. O-ring 64 makes installation easier by preventing barrel 22 from readily falling off of bushing 20.

Standoff 4 is used to secure panel 2 to a structural support. In many applications, a single panel 2 requires a plurality of standoffs 4 such as the stair panels 2 depicted in FIG. 1 wherein the center stair panel 2 is supported by six standoffs 4. When such a project is designed, the desired locations for standoffs 4 are located and panel 2 is formed with openings 10. The installer is faced with the task of installing standoffs into support structures 6 to arrange panel 2 with vertical sides and upper and lower surfaces that are aligned with the other panels 2.

Figure 9:
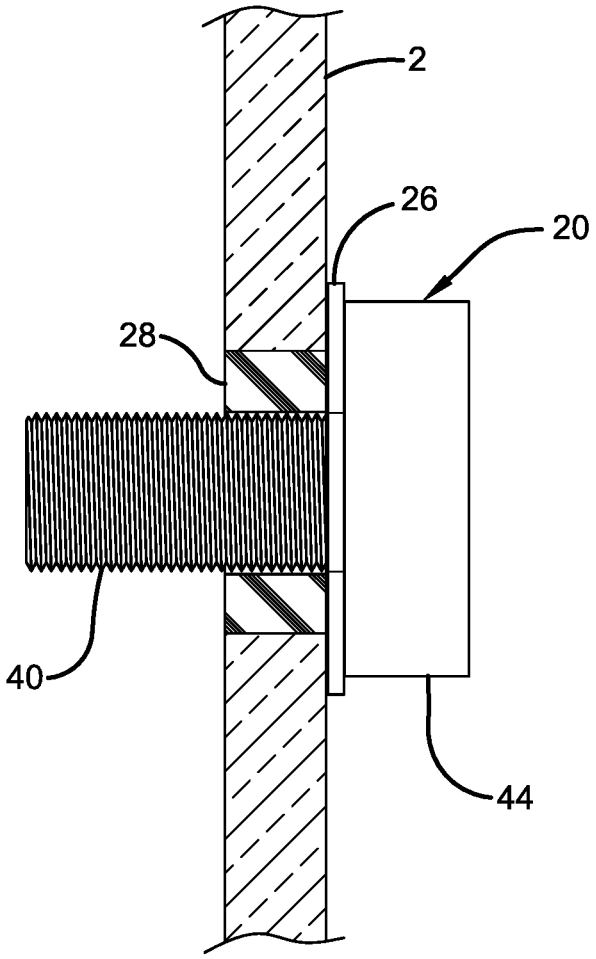
FIG. 9 is an elevation view, partially in section, showing a step of installing the standoff with the bushing disposed through the mounting opening of the glass.

Standoffs 4 are used by first installing washers 26 and 28 as well as bushing 20 into an opening 10 as shown in FIG. 9. The other washer 28 is added as shown in FIG. 10 and then barrel 22 is mounted. Barrel 22 can be threaded onto shank 40 by hand or with a power tool inserted into recess 52 of bushing 20. Barrel 22 is threaded onto shank 40 until washers 26 are at least slightly compressed. These parts of standoffs 4 are installed at each opening 10 for panel 2.

The installer and a helper can then hold up panel 2 with the installed parts of standoffs 4 at the location where it is to be installed and directly install anchor fasteners 12 to secure panel. Directly installing anchor fasteners 12 without pilot holes is possible with some structural support materials and with some anchor fasteners 12. For example, a lug screw can be directly driven into some wood structural supports. A power tool can be used to drive anchor fastener 12 into support structure 6 through engagement with fastener head 50. This allows anchor fastener 12 to be quickly installed and its location being determined simply by holding panel 2 in the desired location. In other situations where pilot holes are desired, the installer can drill pilot holes 70 (see FIG. 11) directly through openings 54 and then install anchor fasteners 12. These can be drilled one at a time with the installation of anchor fastener 12 immediately following the drilling of pilot hole 70. In another alternative, the installer can mark the locations for anchor fasteners 12 either directly through openings 54 or about the outer perimeters of barrels 22. With the positions marked, the installer can remove panel 2 and drill pilot holes for anchor fasteners 12. Panel 2 is then re-aligned and anchor fasteners 12 are installed.

After anchor fasteners 12 are installed, end caps 24 are added and secured by their set screws.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Modifications and alterations of those embodiments will be apparent to one who reads and understands this general description. The present disclosure should be construed as including all such modifications and alterations insofar as they come within the scope of the appended claims or equivalents thereof. Throughout the description and claims of this specification the words "comprise" and "include" as well as variations of those words, such as "comprises," "includes," "comprising," and "including" are not intended to exclude additives, components, integers, or steps.

The invention claimed is:

1. A standoff for mounting a panel to a support structure; the panel defining a mounting opening and first and second exterior surfaces; the standoff comprising:

a bushing having a shank and a head; the bushing defining an opening that extends entirely through the shank and head;

the shank adapted to pass through the mounting opening of the panel with the head adapted to be disposed outside the first exterior surface of the panel;

a barrel defining an opening that extends entirely through the barrel; the barrel adapted to be disposed outside the second exterior surface of the panel such that portions of the first and second exterior surfaces of the panel are directly between the head and the barrel;

a portion of the shank of the bushing being disposed in the opening of the barrel; the opening of the bushing being aligned with the opening of the barrel such that an anchor fastener can pass through the bushing and the barrel into a support structure to which the panel is to be mounted; and an end cap carried on the head of the bushing; the end cap defining a recess that receives at least a portion of an anchor head of the anchor fastener.

2. The standoff of claim 1, further comprising an interior washer disposed around a portion of the shank of the bushing; the interior washer adapted to be disposed in the mounting opening of the panel.

3. The standoff of claim 1, further comprising first and second exterior washers disposed around portions of the shank of the bushing; the first exterior washer adapted to be disposed between the panel and the barrel; and the second exterior washer adapted to be disposed between the panel and the head of the bushing.

4. The standoff of claim 3, wherein:

each of the exterior washers has a maximum width dimension;

the barrel having first and second ends; the first end adapted to face the panel; the first end having a maximum width dimension;

the maximum width dimension of the first exterior washer being no larger than the maximum width dimension of the first end of the barrel;

the head of the bushing having first and second ends; the first end adapted to face the panel; the first end having a maximum width dimension; and the maximum width dimension of the second exterior washer being larger than the maximum width dimension of the first end of the head of the bushing.

5. A standoff for mounting a panel to a support structure; the panel defining a mounting opening; the standoff comprising:

a bushing having a shank and a head; the bushing defining an opening that extends entirely through the shank and head;

the shank adapted to pass through the mounting opening of the panel;

a barrel defining an opening that extends entirely through the barrel;

a portion of the shank of the bushing being disposed in the opening of the barrel; the opening of the bushing being aligned with the opening of the barrel such that an anchor fastener can pass through the bushing and the barrel into a support structure to which the panel is to be mounted;

first and second exterior washers disposed around portions of the shank of the bushing; the first exterior washer adapted to be disposed between the panel and the barrel; and the second exterior washer adapted to be disposed between the panel and the head of the bushing;

each of the exterior washers having a maximum width dimension;

the barrel having first and second ends; the first end adapted to face the panel; the first end having a maximum width dimension;

the maximum width dimension of the first exterior washer being no larger than the maximum width dimension of the first end of the barrel;

the head of the bushing having first and second ends; the first end adapted to face the panel; the first end having a maximum width dimension;

the maximum width dimension of the second exterior washer being larger than the maximum width dimension of the first end of the head of the bushing; and further comprising an end cap removably carried on the head of the bushing; the end cap having a maximum width dimension; and the maximum width dimension of the second exterior washer being no larger than the maximum width dimension of the end cap.

6. The standoff of claim 1, wherein the exterior of the shank is threaded; the opening of the barrel is threaded; and the shank threadedly engaging the barrel.

7. The standoff of claim 1, wherein the shank slidably engages the barrel.

8. A standoff for mounting a panel to a support structure; the panel defining a mounting opening; the standoff comprising:

a bushing having a shank and a head; the bushing defining an opening that extends entirely through the shank and head;

the shank adapted to pass through the mounting opening of the panel;

a barrel defining an opening that extends entirely through the barrel;

a portion of the shank of the bushing being disposed in the opening of the barrel; the opening of the bushing being aligned with the opening of the barrel such that an anchor fastener can pass through the bushing and the barrel into a support structure to which the panel is to be mounted;

an end cap carried on the head of the bushing; the end cap adapted to cover an anchor head of the anchor fastener; and wherein the end cap has a maximum width dimension; the barrel having a maximum width dimension; the maximum width dimension of the end cap being the same as the maximum width dimension of the barrel.

9. An assembly comprising:

a panel defining a mounting opening and first and second exterior surfaces;

a standoff adapted to mount the panel to a support structure;

the standoff including a bushing having a shank and a head; the bushing defining an opening that extends entirely through the shank and head;

the standoff also including a barrel defining an opening that extends entirely through the barrel; the barrel having an exterior shape and size;

a portion of the shank of the bushing disposed in the barrel; the through hole of the bushing being aligned with the opening of the barrel;

an anchor fastener extending out of the opening of the bushing into the support structure;

a portion of the shank of the bushing being disposed in the mounting opening;

portions of the first and second exterior surfaces of the panel disposed between the head of the bushing and the barrel; and an end cap carried by the head of the bushing to cover an anchor head of the anchor fastener; the end cap having an exterior shape and size that matches the exterior shape and size of the barrel.

10. The assembly of claim 9, further comprising an interior washer disposed around a portion of the shank of the bushing; the interior washer disposed in the mounting opening of the panel.

11. The assembly of claim 9, further comprising first and second exterior washers disposed around portions of the shank of the bushing; the first exterior washer disposed between the panel and the barrel; and the second exterior washer disposed between the panel and the head of the bushing.

12. The assembly of claim 9, wherein the shank is threaded; the barrel is threaded; the shank threadedly engaging the barrel.

13. The assembly of claim 9, wherein the shank slidably engages the barrel.

14. A method of mounting a panel to a support structure with a standoff; the method comprising the steps of:

providing a panel with a mounting opening;

inserting a shank of a bushing through the mounting opening of the panel; the bushing having a head connected to the shank; the bushing defining an opening that extends entirely though the bushing;

connecting a barrel to the shank of the bushing to place a portion of the panel directly between the barrel and the head of the bushing; the barrel defining an opening that extends entirely through the barrel; the opening of the bushing being aligned with the opening of the barrel when the barrel is connected to the shank of the bushing;

inserting an anchor fastener through the bushing and through the barrel;

connecting the anchor fastener into the support structure; and further comprising the step of drilling a pilot hole in the support structure by drilling through the openings of the bushing and barrel while they are attached to the panel; the pilot hole being drilled before the step of inserting an anchor fastener through the bushing and through the barrel.

15. The method of claim 14, further comprising the step of threadedly connecting the shank of the bushing to the barrel.

16. The method of claim 14, further comprising the step of connecting an end cap to the head of the bushing and covering a fastener head of the anchor fastener.

17. The method of claim 14, further comprising the steps of:

positioning an inner gasket in the opening of the panel around the shank of the bushing; and positioning first and second exterior washers around portions of the shank of the bushing; the first exterior washer disposed between the panel and the barrel; and the second exterior washer disposed between the panel and the head of the bushing.

18. The standoff of claim 8, wherein the exterior of the shank is threaded; the opening of the barrel is threaded; and the shank threadedly engaging the barrel.

19. The standoff of claim 8, wherein the shank slidably engages the barrel.

20. The standoff of claim 8, further comprising an interior washer disposed around a portion of the shank of the bushing; the interior washer adapted to be disposed in the mounting opening of the panel.

21. The standoff of claim 8, further comprising first and second exterior washers disposed around portions of the shank of the bushing; the first exterior washer adapted to be disposed between the panel and the barrel; and the second exterior washer adapted to be disposed between the panel and the head of the bushing.

* * * * *